US009648937B1

(12) United States Patent
Echerivel

(10) Patent No.: US 9,648,937 B1
(45) Date of Patent: May 16, 2017

(54) SPLIT-END TOOL

(71) Applicant: Luis V Echerivel, Tucson, AZ (US)

(72) Inventor: Luis V Echerivel, Tucson, AZ (US)

( * ) Notice: Subject to any disclaimer, the term of this patent is extended or adjusted under 35 U.S.C. 154(b) by 184 days.

(21) Appl. No.: 14/582,841

(22) Filed: Dec. 24, 2014

(51) Int. Cl.
*B26D 1/00* (2006.01)
*A45D 24/36* (2006.01)

(52) U.S. Cl.
CPC ..... *A45D 24/36* (2013.01)

(58) Field of Classification Search
CPC ..... A45D 24/36
USPC ..... 132/214
See application file for complete search history.

(56) References Cited

U.S. PATENT DOCUMENTS 2,225,454 A 12/1940 Kayn
4,428,119 A 1/1984 Turner
5,107,591 A * 4/1992 Sato ..... B26B 13/24 30/195
5,519,939 A 5/1996 Smith
5,884,402 A 3/1999 Talavera
6,249,973 B1 6/2001 Hirano
D452,125 S 12/2001 Quessard
6,883,237 B2 4/2005 Klatt et al.
6,883,239 B2 4/2005 Sato
7,007,388 B2 3/2006 Wan
7,024,778 B2 4/2006 Kuechler et al.
2003/0159296 A1 8/2003 Tapia
2004/0045168 A1 3/2004 Talavera
2004/0237313 A1 12/2004 Tanaka
2005/0108880 A1* 5/2005 Wan ..... B26B 19/18 30/123
2006/0283473 A1* 12/2006 Chudzik ..... A45D 24/02 132/125
2008/0127989 A1* 6/2008 Chapman ..... A45D 24/10 132/118
2011/0094532 A1 4/2011 Klein et al.
2011/0302789 A1* 12/2011 Chen ..... B26B 13/24 30/233.5
2013/0255086 A1 10/2013 Croft

* cited by examiner

*Primary Examiner* — Kristen Matter
(74) *Attorney, Agent, or Firm* — Invention To Patent Services; Alex Hobson

(57) ABSTRACT

A manual split-end tool is configured to capture hair over a wedge and within a slot to expose split-ends for removal. The split-end tool has a wedge arm having a wedge that is configured to extend through the slot in a slotted arm. The split-end tool pivots open and closed and in one embodiment has an opening feature to force the slotted arm away from the wedge arm when the tool is in a closed configuration. Hair is captured over the wedge and captured between a first and second slot side. The tool can be slid down along a person's hair, thereby enabling quick removal of split-ends along the length of a person's hair. The wedge may have a smooth rounded extended end, a scalloped edge or a plurality of teeth.

19 Claims, 12 Drawing Sheets

SPLIT-END TOOL

BACKGROUND OF THE INVENTION

Field of the Invention

The present invention relates a tool for exposing the split-ends, along the length of a person's hair, for removal.

Background

Split-ends and broken ends of hair can be caused by uneven hair growth, razor cutting, texturing, chemical treatment and the like. Hair stylist and barbers go to great lengths to remove split-ends.

SUMMARY OF THE INVENTION

The invention is directed to a split-end tool that captures a person's hair and bends it over a wedge to expose split-ends for removal. The tool can be slid down along a person's hair, thereby enabling quick removal of split-ends along the length of a person's hair. Split-ends, as used herein with reference to a person's hair, is hair that splits prior into two or more stands prior to termination or at the hair end. An exemplary split-end tool comprises a wedge arm and a slotted arm that pivot open and closed. The wedge of the wedge arm is configured to fit within the slot of the slotted arm and capture hair over the wedge, and under the first and second slot sides. The hair is bent over the wedge at a high angle, substantially 180 degrees and at a small bend radius, thereby causing any split-ends to stick out for cutting. In an exemplary embodiment, the wedge arm and slotted arm are coupled together proximal to the pivot end and/or by the pivot, thereby allowing the extended ends to open and close. In an exemplary embodiment, the wedge arm and slotted arm have handles that are configured between the pivot and the slotted and wedge portions.

The wedge arm comprises a wedge portion that is configured proximal to the extended end. In an exemplary embodiment, a wedge portion comprises a wedge retainer and a wedge that has an extended wedge end configured to fit through the slot. The wedge and wedge retainer may be integral or made from a single piece of material and/or may be substantially affixed to each other, whereby the wedge is not configured to be detachably attached to the wedge retainer. In another embodiment, a wedge is configured to be detachably attached to the wedge retainer. In an exemplary embodiment, a detachably attachable wedge has a wedge retainer feature, such that an enlarged portion that is configured to fit within a groove within the wedge retainer.

A wedge has an extended wedge end that fits through the slot and retains the hair in a bent configuration. The portion of the wedge that extends through the slot when the split-end tool is in a closed configuration is the protruding wedge portion. A protruding wedge portion may extend, or protrude through any suitable distance, including, but not limited to, about 3 mm or more about 5 mm or more, about 10 mm or more about 20 mm or more, about 40 mm or more, about 50 mm or more and any range between and including the protruding heights provided.

An extended wedge end may be straight and smooth, or may be textured and comprise a plurality of undulations, be scalloped or may comprise a plurality of teeth, for example. An exemplary extended wedge end is non-cutting, wherein the edge is not sharp, having substantially rounded, or non-sharp edges and does not contact the slotted arm sides when the split-end tool is closed. In another embodiment, an extended wedge end may be recessed from protruding wedge ends. The type of extended wedge end may be selected for a specific type of hair. For example, a smooth extended wedge end or edge may be better for wavy hair, a scalloped end may be better for fine to medium hair and a toothed end may be better for medium to coarse hair. A scalloped extended wedge end may have any suitable center-to-center distance between the scallops including, but not limited to, no more than about 10 mm, no more than about 8 mm, no more than about 5 mm, no more than about 3 mm, no more than about 1 mm and any range between and including the center-to-center distances provided. A scalloped extended wedge end may have any suitable center-to-center distance between the teeth including, but not limited to, no more than about 25 mm, no more than about 15 mm, no more than about 10 mm, no more than about 5 mm, no more than about 3 mm and any range between and including the center-to-center distances provided. The height of the teeth may be any suitable height including, but not limited to, about 1 mm or more, about 2 mm more, about 4 mm or more, about 10 mm or more, about 15 mm or more and any range between and including the teeth height values provided. The thickness of the extended wedge end will impact the radius of curvature of the hair captured in the split-end tool. An extended wedge end may have any suitable thickness including, but not limited to, no more than 20 mm, no more than 15 mm, no more than 10 mm, no more than 5 mm, no more than 2 mm and any range between and including the thickness values provided. The extended wedge end may be rounded to facilitate sliding the tool along a person's hair and may have a radius of curvature that is equal to one-half the thickness values of the extended wedge end or greater. A wedge may have any suitable length including, but not limited to, about 5 cm or more, about 10 cm or more, about 15 cm about 20 cm or more and any range between and including the length values provided.

A wedge may be uniform in thickness or may have non-uniform thickness from the retained end to the extended wedge end. The shape or profile of a cross-section of a wedge across the length may be rectangular, triangular, trapezoidal, or irregular in shape. An irregularly shaped wedge may be thicker at the extended end, such as having a bulb like extended end, to expose the split-ends but allow the hair to more easily slide over the extended wedge end.

An exemplary slotted arm comprises a slotted portion having a first slot side and second slot side that extend substantially parallel, with a slot therebetween. A slot arm may have an open extended end or a closed extended end. A slotted portion may comprise an aperture in the slotted portion that is the slot. An exemplary slot is longer than the wedge to ensure that the wedge will easily fit through the slot. An exemplary slot is wider than the thickness of the extended wedge end to ensure that that wedge will fit within the slot and to accommodate for hair that must also fit between the wedge and within the slot. A slot may be wider than the thickness of the wedge by any suitable amount including about 1 mm or more, about 3 mm or more, about 5 mm or more, about 8 mm or more, about 10 mm or more, about 15 mm or more and any range between and including the values provided. The gap, or space between the wedge and either the first or second slot sides, may be one half the difference between the width of the slot and the width of the wedge.

An exemplary split-end tool is configured to open and close about a pivot that is configured proximal to the pivot end of both the wedge and slotted arms. Any suitable type of pivot or hinge may be configured to enable the two arms to pivot away from each other to an open orientation and toward each other to a closed orientation. In an exemplary embodiment, the wedge and slotted arms comprise a hinge aperture and are pinned together through said hinge aperture to allow both arms to pivot about the pin.

An exemplary split-end tool may comprise an opening feature that is configured to force the two arms apart when in a closed position. An opening feature may comprise a spring that is attached to one arm and is compressed when the two arms are brought toward one another. The spring force will increase as the two arms are brought to a closed position. One of the arms may comprise a spring capture that is configured to retain the extended end of the spring from the opposing arm as the split-tool is closed. In another exemplary embodiment, a torsional spring may be configured with the hinge and/or the pivot device.

An exemplary split-end tool may comprise a handle on both the wedge and slotted arms for manipulation of the tool. The handles are configured between the pivot and the slotted and wedge portions. The handles may simply be an extension of the arms or may comprise a handle cover to provide better feel and comfort. A handle may comprise leather, fabric, foam, composite materials, or cloth, for example.

The split-end tool may be made out of any suitable material including, but not limited to, metal, plastic, wood, composite, and any combination of materials. For example, the slotted arm and wedge arm may be plastic and the wedge may be metal. The split-end tool may comprise weight saving cut-out portions, wherein a portion of material is removed to reduce the weight of the tool. A lightweight split-end tool is preferred as it will be used for long periods of time.

The split-end tool, as described herein may, consist essentially of a wedge arm and slotted arm, as described herein, attached at a pivot. A split-end tool, as described herein, may be a completely manual tool that is operated only by hand and requires no electrical power.

A split-end tool, as described in any of the embodiments herein, may be used to expose split-ends for removal. A grouping of hairs may be placed over the wedge of the split-end tool and the tool may then be closed. As the wedge is forced through the slot, the grouping of hairs will be bent about the wedge in a tight angle, such as about 180 degrees. The split-ends of the grouping of hairs will extend from the bent portion of hair, or the hair that is proximal to the extended wedge end. A hair stylist may then cut off the exposed and extending split-ends. The stylist may then slide the split-end tool down the grouping of hairs, thereby exposing more split-ends.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
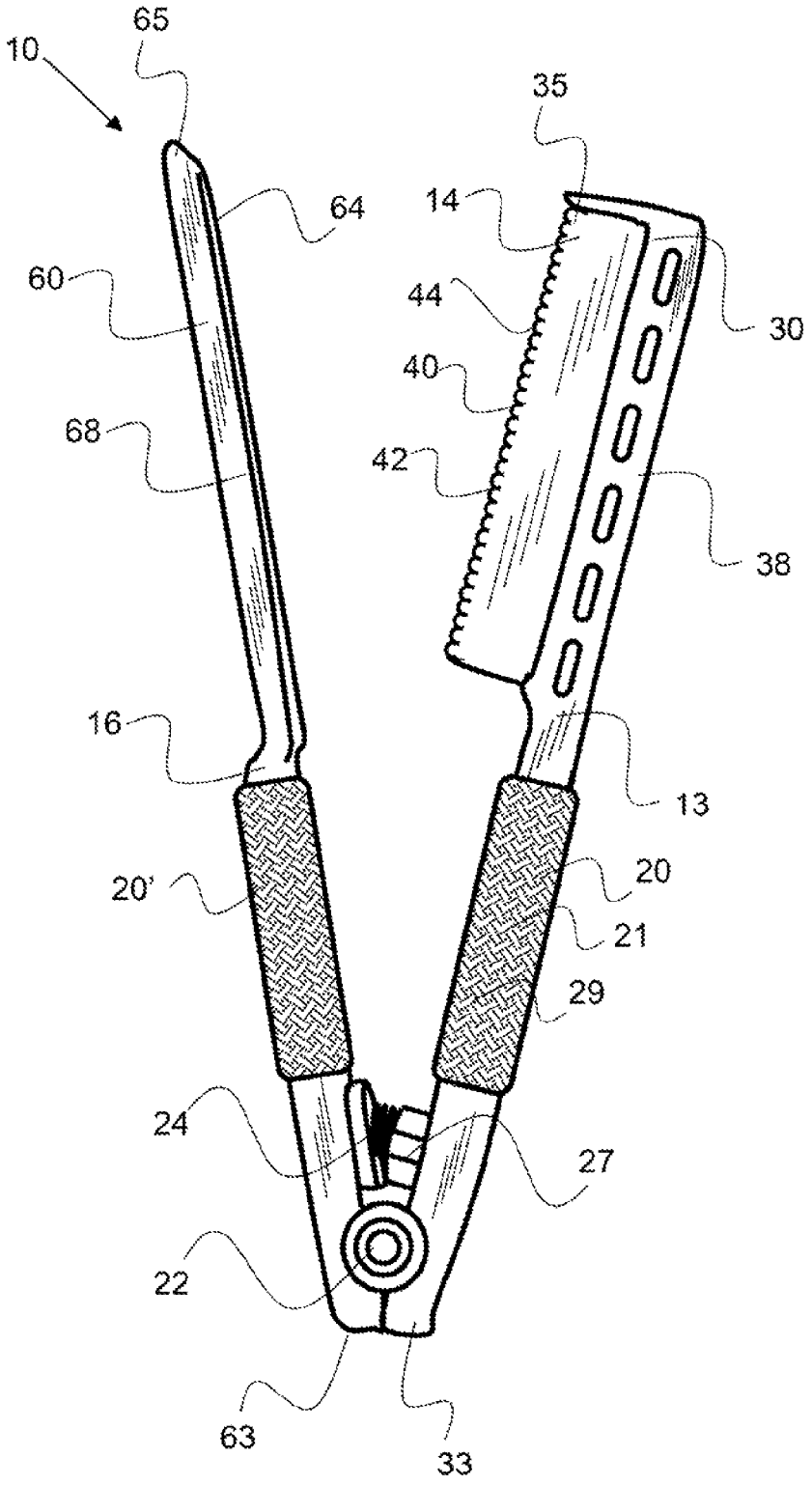

FIG. 1 shows a side view of an exemplary split-end tool having a wedge arm and a slotted arm.

Figure 2:
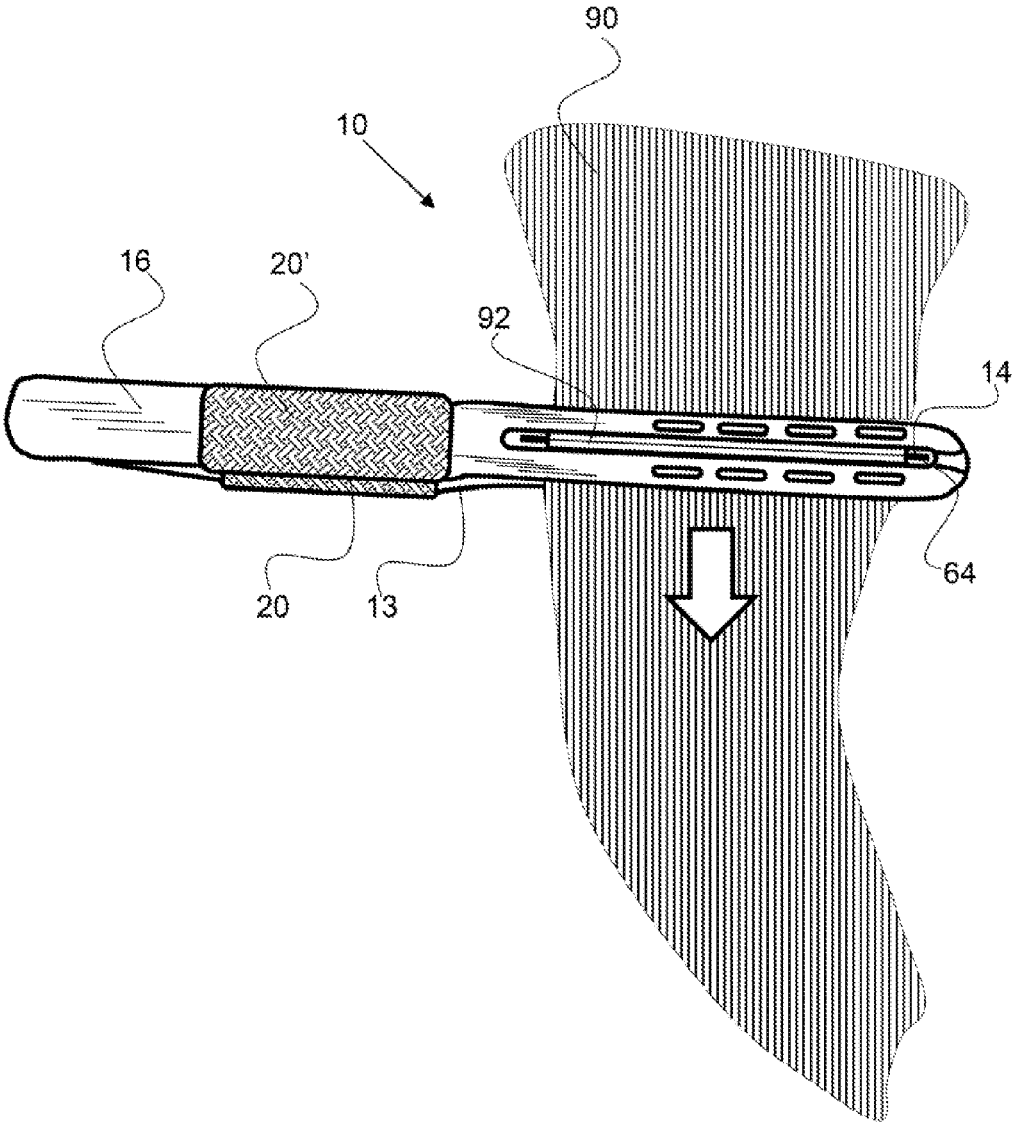

FIG. 2 shows a top-down view of an exemplary split-end tool having hair captured over the wedge and within the slot of the slotted arm.

Figure 3A:
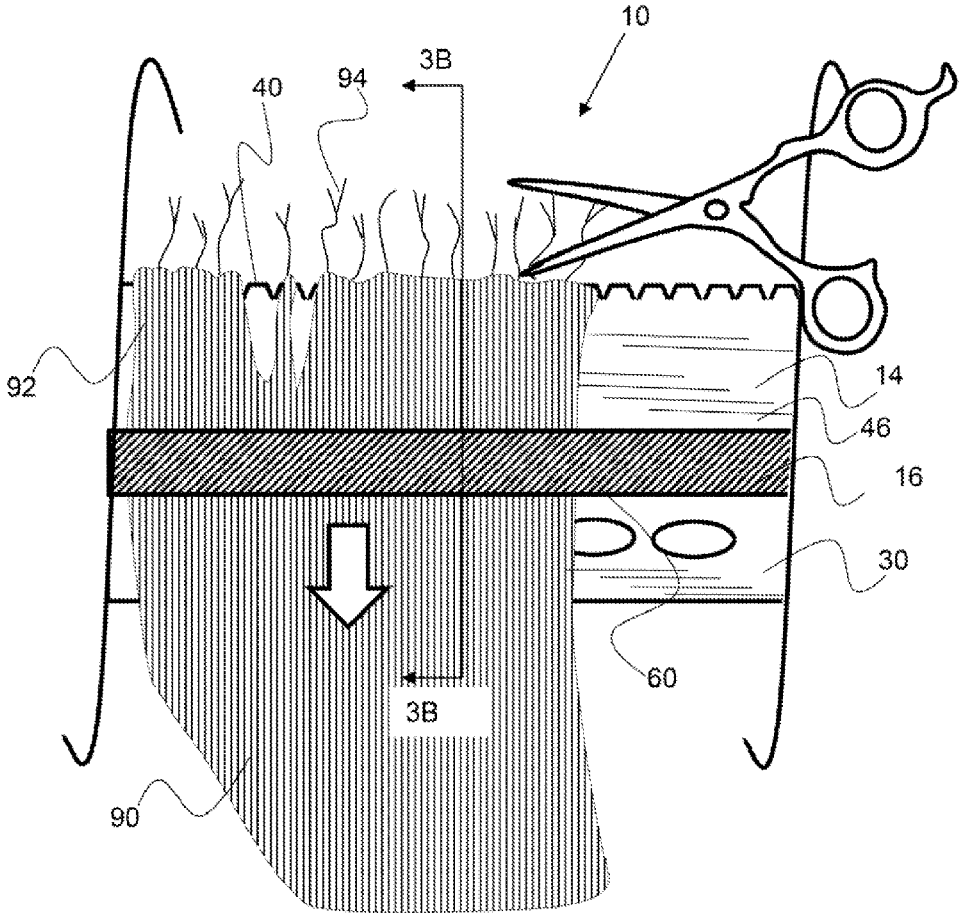

FIG. 3A shows an enlarged side view of a portion of an exemplary split-end tool having hair captured over the wedge and within the slotted arm.

Figure 3B:
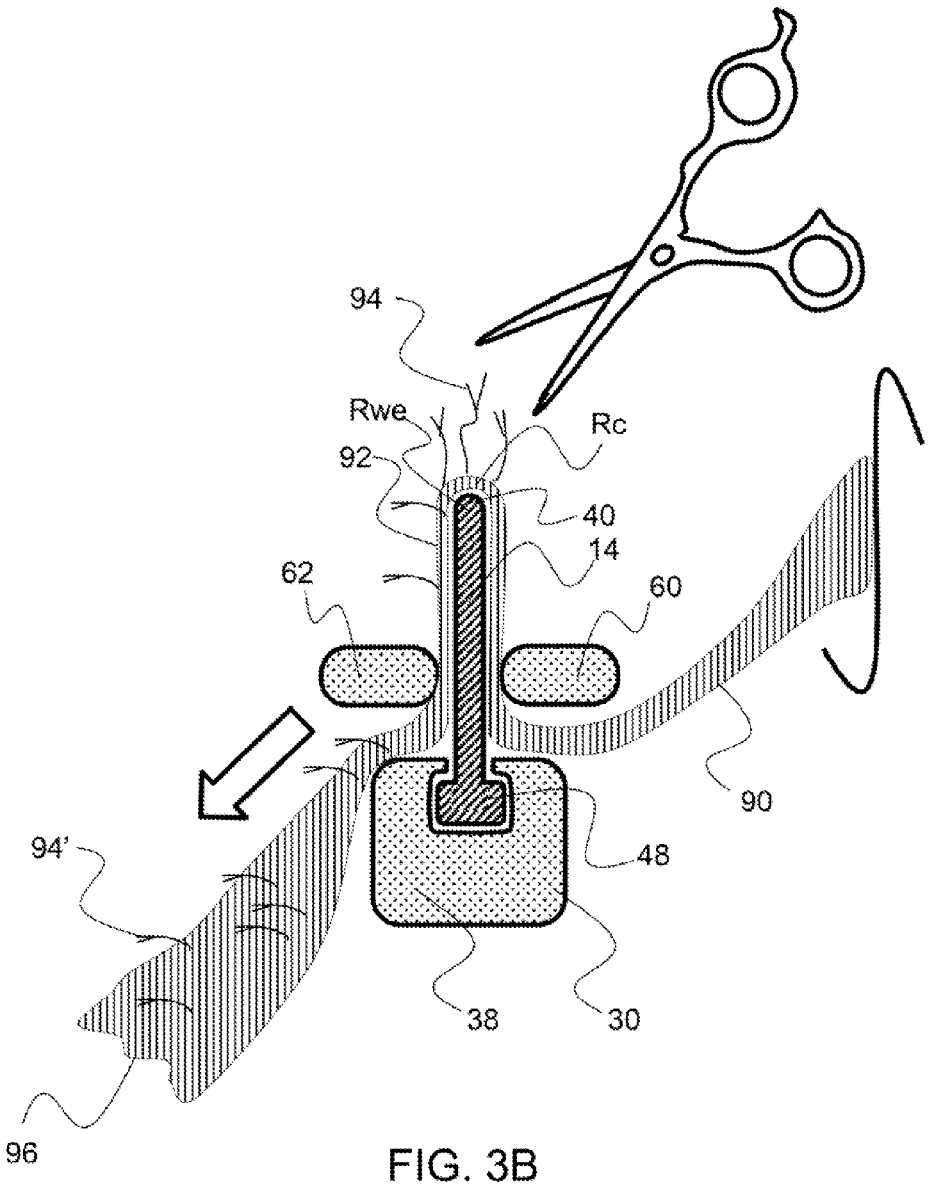

FIG. 3B shows an enlarged cross-sectional view of the split-end tool shown in FIG. 3A along line 3B and shows hair captured over the wedge and within the slot of the slotted arm.

Figure 4:
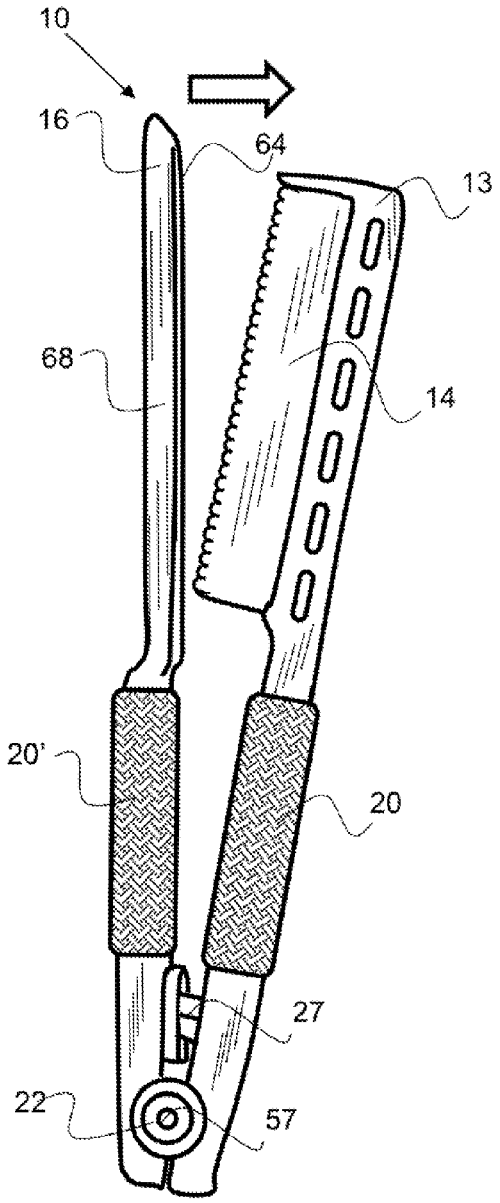

FIG. 4 shows a side view of an exemplary split-end tool having a wedge arm and a slotted arm in a partially open configuration.

Figure 5:
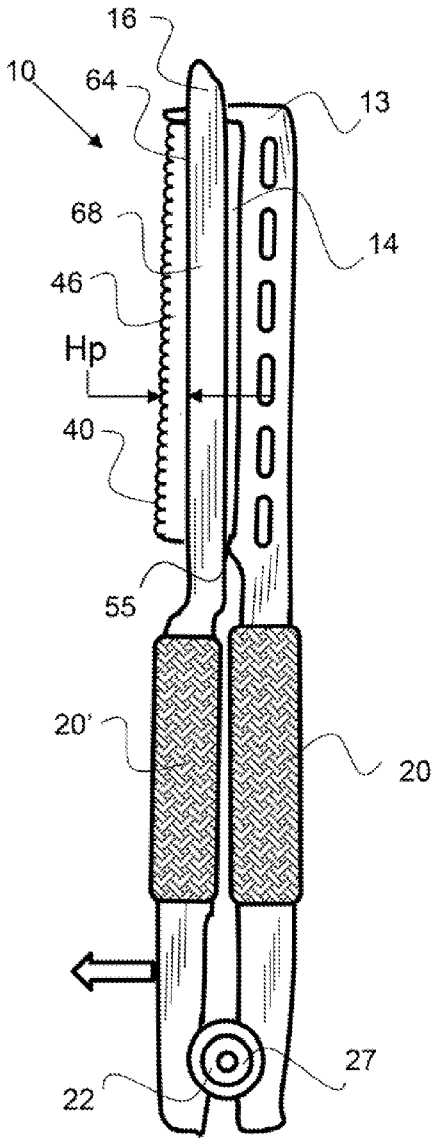

FIG. 5 shows a side view of an exemplary split-end tool having a wedge arm and a slotted arm in a closed configuration.

Figure 6A:
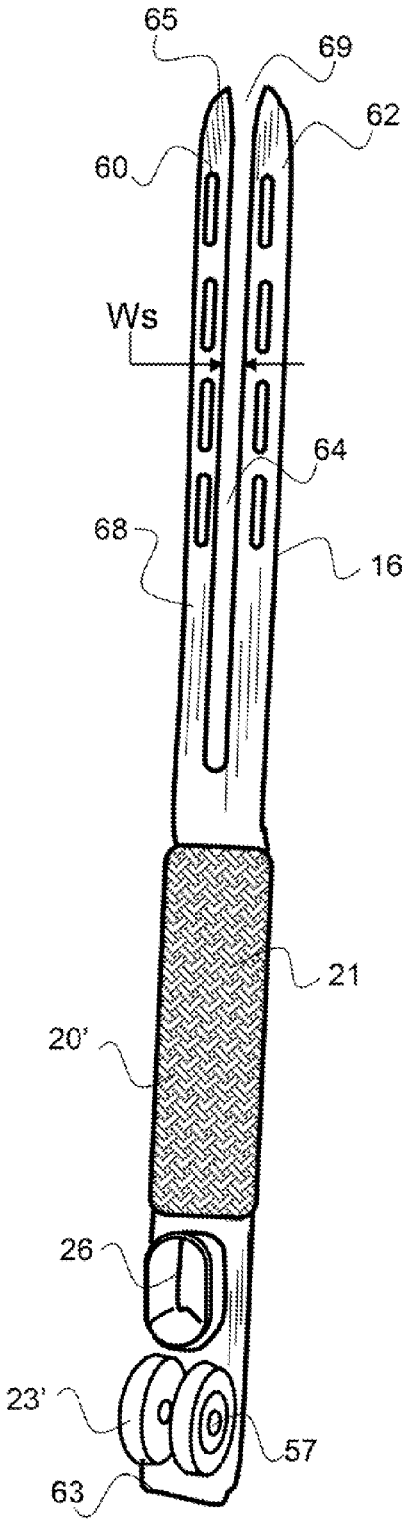
Figure 6B:
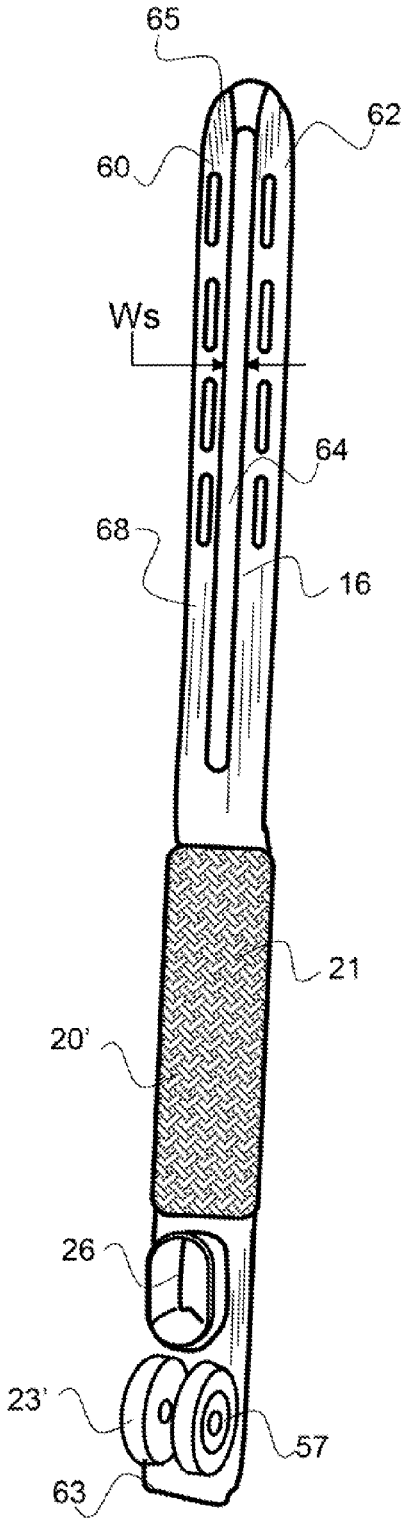

FIG. 6A and FIG. 6B show top-down views of exemplary slotted arms of a split-end tool, as described herein.

Figure 7:
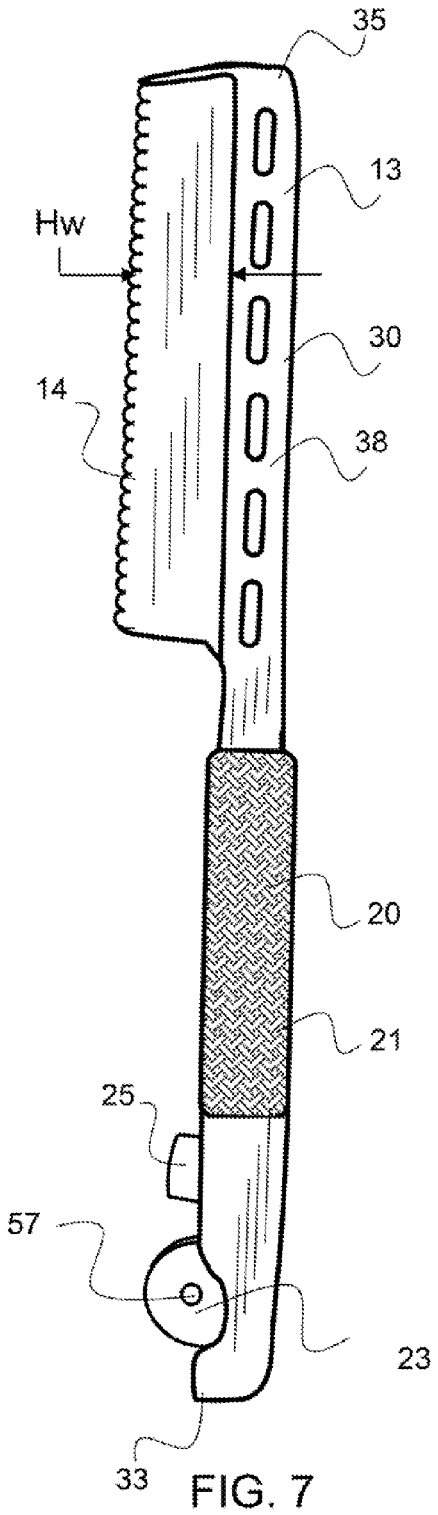

FIG. 7 shows a side view of an exemplary wedge arm of a split-end tool as described herein.

Figure 8:
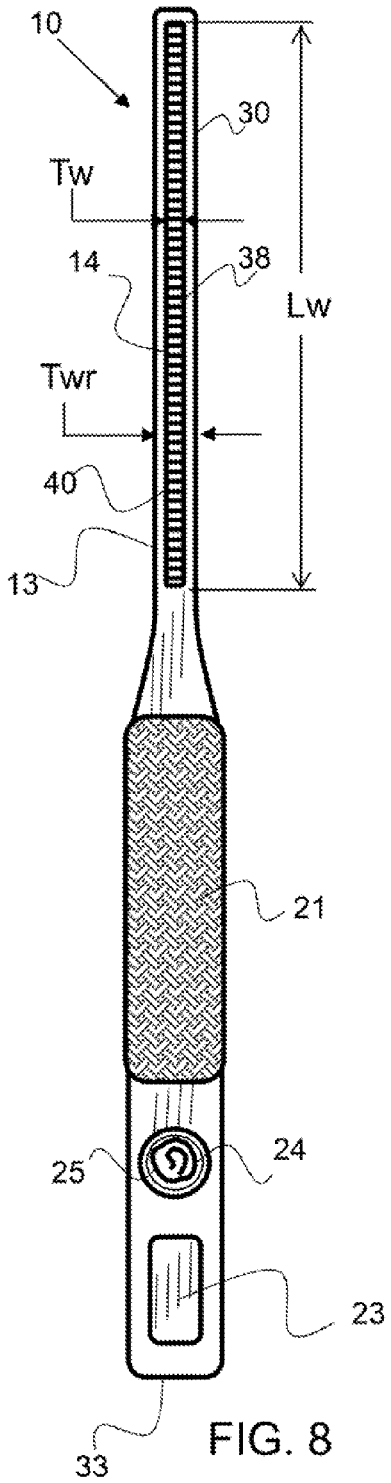

FIG. 8 shows a top-down view of an exemplary wedge arm of a split-end tool as described herein.

Figure 9:
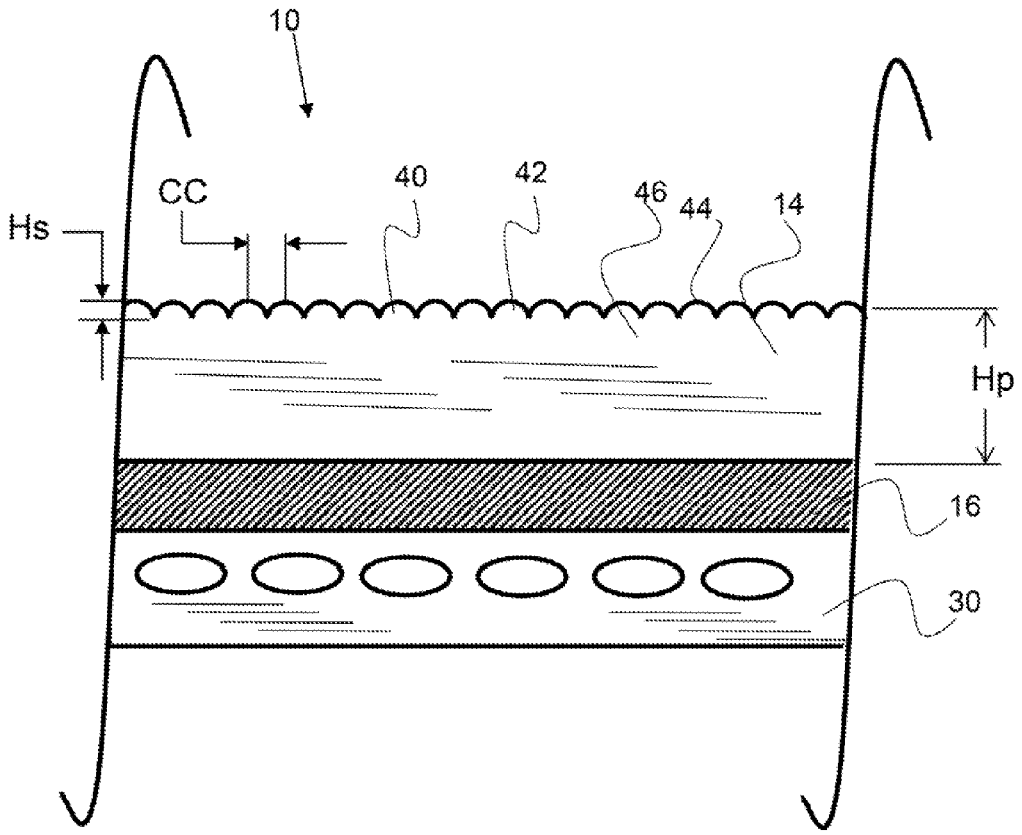

FIG. 9 shows an enlarged side view of a portion of an exemplary split-end tool having a scalloped extended wedge end.

Figure 10:
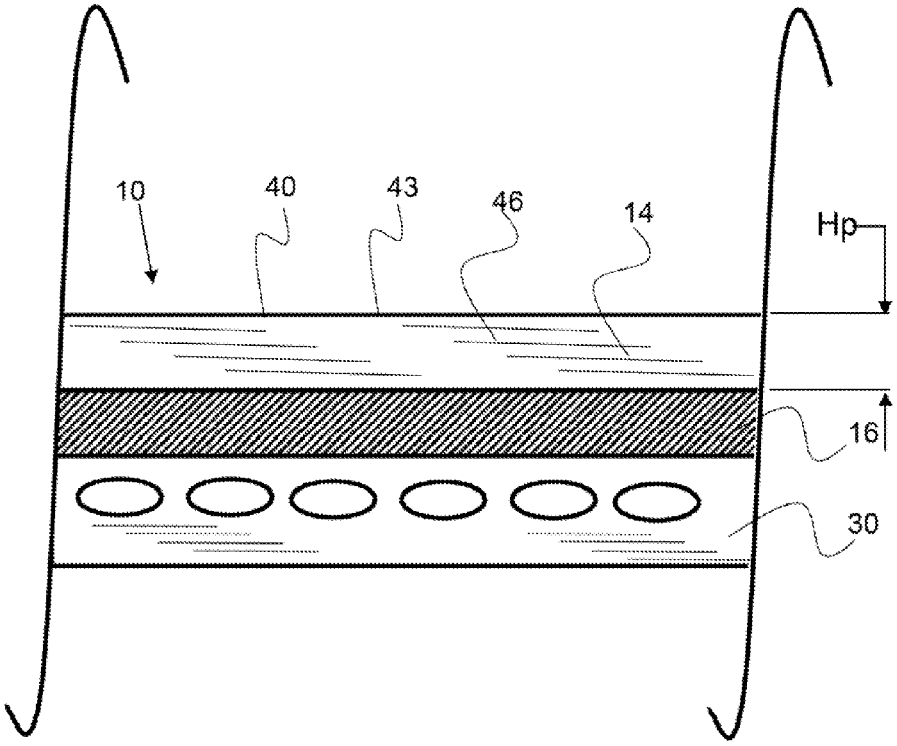

FIG. 10 shows an enlarged side view of a portion of an exemplary split-end tool having a smooth extended wedge end.

Figure 11:
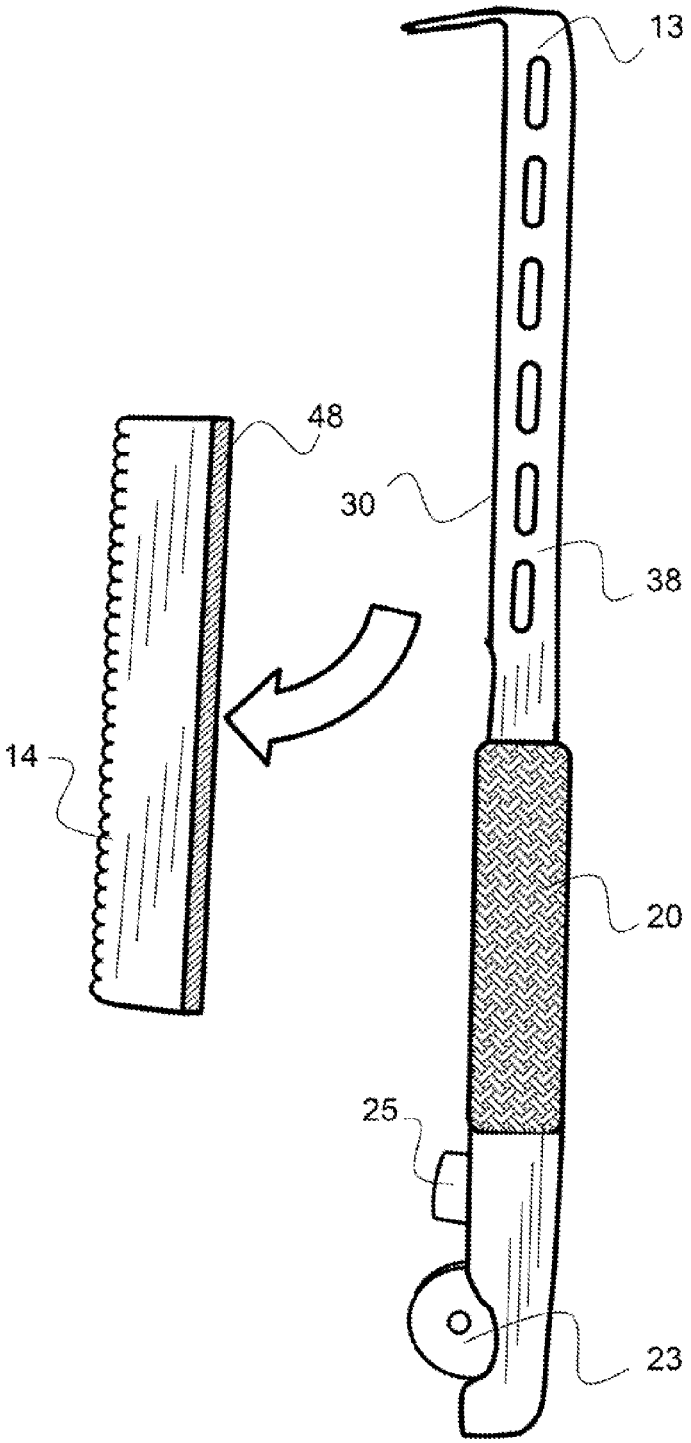

FIG. 11 shows a side view of an exemplary wedge arm with a wedge detached.

Figure 12:
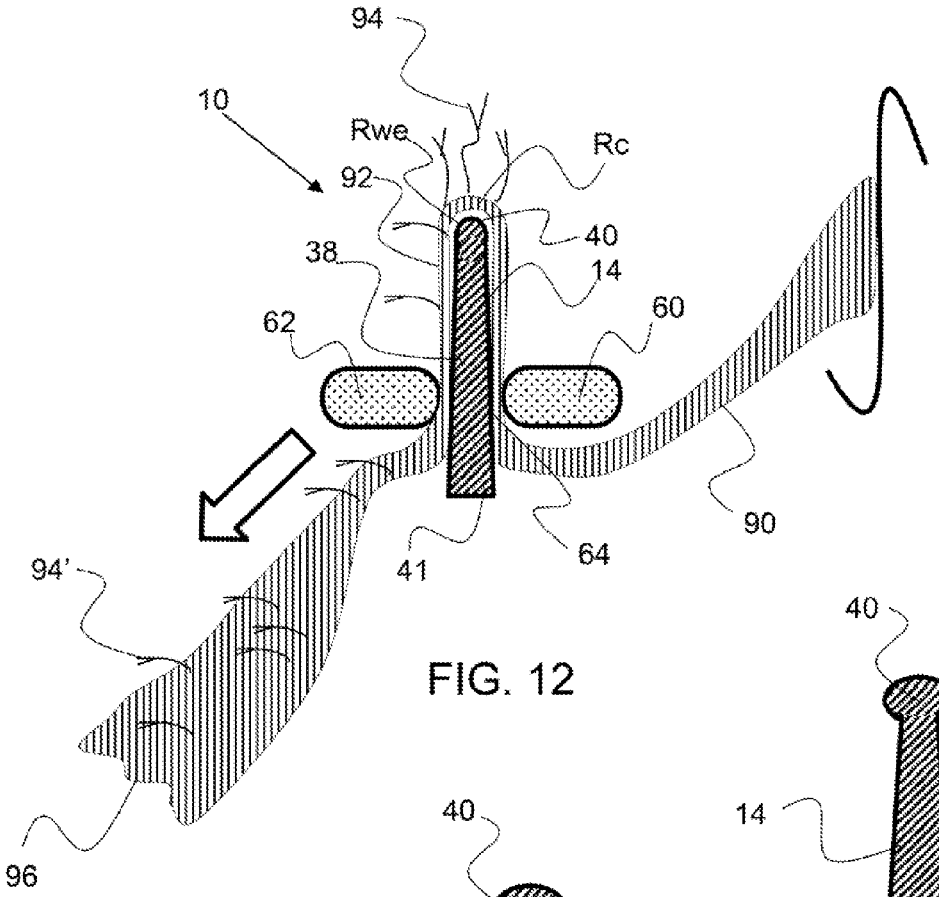

FIG. 12 shows a cross-sectional view of an exemplary split-end tool having hair captured over the wedge and within the slot of the slotted arm.

Figure 13:
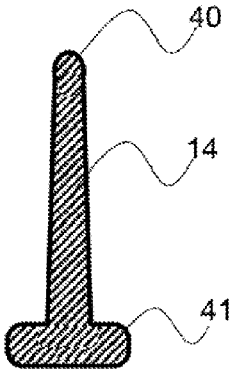

FIG. 13 shows a cross-sectional view of an exemplary wedge that is more narrow at the top, or the extended wedge end, than at the base of the wedge.

Figure 14:
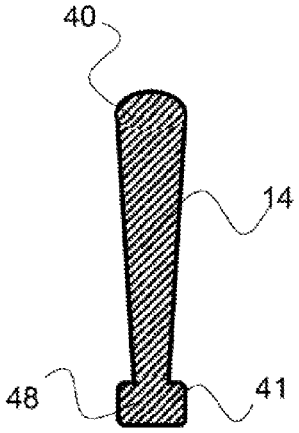

FIG. 14 shows a cross-sectional view of an exemplary wedge that is wider at the top, or the extended wedge end, than at the base of the wedge.

Figure 15:
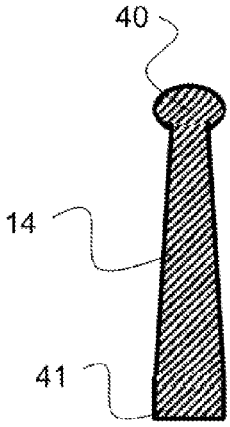

FIG. 15 shows a cross-sectional view of an exemplary wedge that has an enlarged and rounded extended wedge end.

Figure 16:
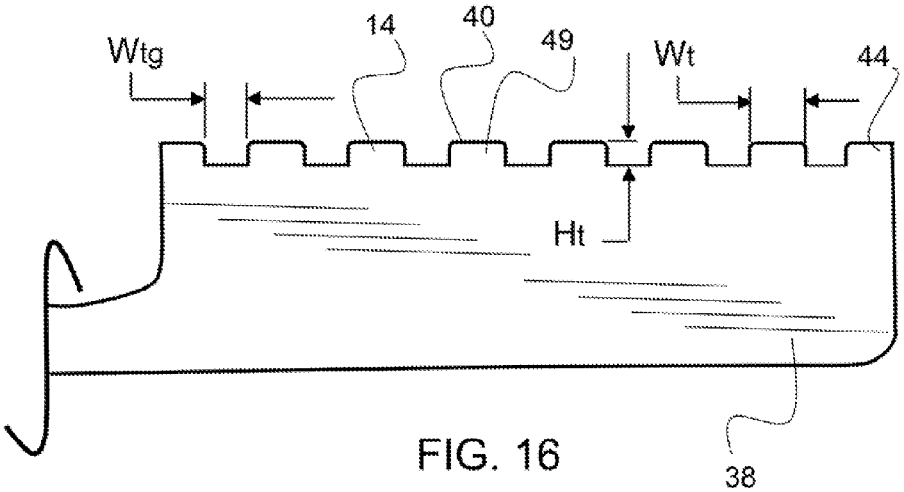

FIG. 16 shows a side view of an exemplary wedge portion having an extended wedge end that is configured with a plurality of teeth.

Figure 17:
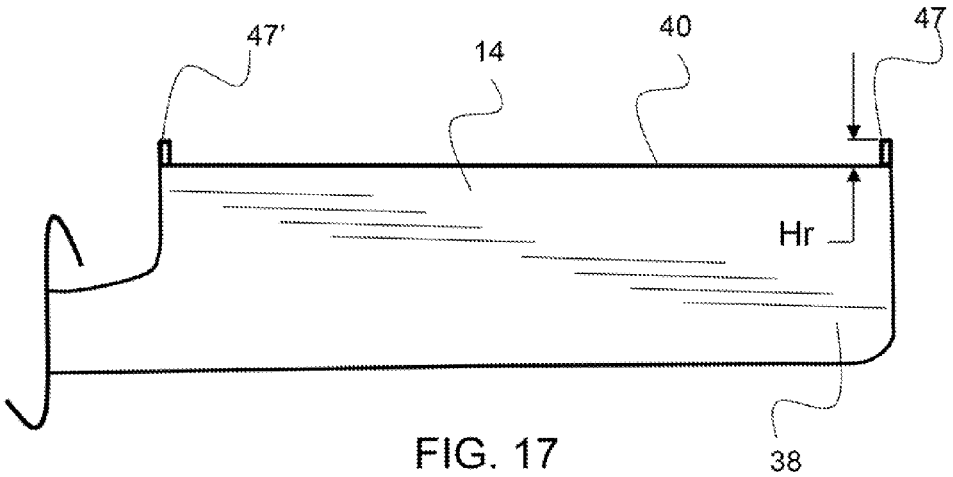

FIG. 17 shows a side view of an exemplary wedge portion having an extended wedge end that is recessed along the length from a front and a back protrusion.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

As shown in FIG. 1, an exemplary split-end tool 10 has a wedge arm 13 and a slotted arm 16. The wedge arm has a wedge portion 38 that has a wedge retainer 30 and a wedge 14 that is configured to extend through a slot 64 in the slot portion 68. The extended wedge end 40 is a textured extended wedge end 44. The scalloped extended wedge end 42 comprises a plurality of rounded undulations along the edge of the wedge. The split-end tool has a pair of handles 20, 20' for manipulating the tool. The handles are configured on both the wedge arm and the slotted arm between the pivot ends 33, 63 and the wedge portion 38 and the slot portion 68 respectively. An opening feature 27 is configured to force the extended ends 35, 65 of the wedge arm and slotted arm away from each other when the split-end tool is forced into a closed position. The opening feature shown comprises a spring 24 that is compressed when the split-end tool is closed. The wedge arm and slotted arm are configured to open and close about the pivot 22.

As shown in FIG. 2, an exemplary split-end tool 10 has hair 90 captured over the wedge 14 and within the slot 64 of the slotted arm 16. The captured hair 92 is forced into a bent orientation over the wedge and this bent configuration exposes any split or broken ends of the hair. The wedge 14 extends up through the slot 64 and there is sufficient space between the wedge and the slot to hold and retain the grouping of hairs in the tool.

As shown in FIGS. 3A and 3B, an exemplary split-end tool 10 has hair 90 captured over the wedge 14 and within the slot of the slotted arm 16. The captured hair 92 is bent over the extended wedge end 40 and is restrained by the first slot side 60 and the second slot side 62. The high bend angle, substantially 180 degrees wherein the captured hair is folded completely over the wedge, as shown, exposes split-ends that can be easily removed. Scissors are shown in FIGS. 3A and 3B cutting away the exposed split-ends 94. The radius of curvature Rc of the hair over the wedge 14 will depend on the thickness of the wedge and to some degree the height of the protruding wedge portion 46. As shown in FIG. 3B, the split-end tool is being slid down the person's hair 90 to the end of the person's hair 96, as indicated by the large bold arrow. As the tool is slid down to the end of the hair 96, the split-ends 94 are being cut off. The extended wedge end 40 is rounded and smooth to allow the hair to slide over the extended wedge end without snagging. The extended wedge end may have a radius of curvature, Rwe, that is half the thickness of the extended wedge end, for example. Also shown in FIG. 3B, a wedge retainer feature 48, or enlarged portion of the wedge, is retained in a slot of the wedge retainer 30.

As shown in FIG. 4, an exemplary split-end tool 10 has a wedge arm 13 and a slotted arm 16 that are in a partially open configuration.

As shown in FIG. 5, an exemplary split-end tool 10 has a wedge arm 13 and a slotted arm 16 in a closed configuration. The wedge 40 is protruding through the slot 64. The portion of the wedge that extends through the slot, or the protruding wedge portion 46 has a height of Hp. The wedge arm and slotted arm have an interference location 55, or a point where the two arms hit each other when the arms are bought to a closed position.

As shown in FIG. 6A, an exemplary slotted arm 16 has an extended end 65 with an extended end opening 69. The slotted portion 68 of the slot arm 16 comprises a first slot side 60 and a second slot side 62 that are substantially aligned along either side of the slot 64 formed therebetween. The handle 20' is configured between the extended end 65 of the slot arm and the pivot end 63. Proximal the pivot end is a pivot portion 23', that is coupled with a pivot portion on the wedge arm. Also proximal the pivot end is a spring capture 26 that is configured to capture a spring attached to the wedge portion. The handle 20' is configured with a handle cover 21.

As shown in FIG. 6B, an exemplary slotted arm 16 has an extended end 65 that is closed. The slot 64 shown is an aperture in the slotted portion 68. The width of the slot Ws may be any suitable width as described herein. In an exemplary embodiment, Ws is substantially greater than the thickness of the wedge to accommodate the hair that must fit over the wedge and the within the slot.

As shown in FIGS. 7 and 8, an exemplary wedge arm 13 has a wedge portion 38 proximal the extended end 35 of the wedge arm 13. The wedge portion comprises the wedge 14 and the wedge retainer 30. At least a portion of the wedge is configured to fit through the slot of the slot arm and the wedge retainer is configured to hold the wedge. The height of the wedge Hw may be any suitable height as described herein. In addition, the length of the wedge Lw may be any suitable length as described herein. As shown in FIG. 8, the extended wedge end 40 has a thickness Tw that may be less than the thickness of the wedge retainer Twr. The wedge arm 13 comprises a pivot portion 23 proximal the pivot end 33 that is configured to couple with a pivot portion of the slot arm to create a pivot. A spring retainer 25 and spring 24 are shown configured proximal the pivot end 33. The pivot portions of both the wedge arm and slotted arm have a pin aperture 57 that is configured to receive a pin 58, as shown in FIG. 4

As shown in FIG. 9, an exemplary split-end tool 10 has a textured extended wedge end 44 or edge comprising a plurality of undulations, or put another way, comprises a scalloped extended wedge end 42. The scalloped extended wedge end has a plurality of rounded undulations with a center-to-center distance CC and a height of the scallops Hs. In an exemplary embodiment, the extended wedge end has no sharp edges that may damage hair as it is pulled through the split-end tool. The scalloped extended wedge end geometry may be well suited for fine to medium hair.

As shown in FIG. 10, an exemplary split-end tool 10 has a straight extended wedge end 43. The extended wedge end may have a radius of curvature to prevent any snagging of hair as it is pulled through the split-end tool.

As shown in FIG. 11, an exemplary wedge arm 13 is configured for detachably attaching a wedge 14. The wedge 14 is detached from the wedge retainer 30. A wedge retainer may comprise a slot or groove for retaining a detachable wedge, for example. A wedge may have a wedge retainer feature 48 that is configured to detachably retain the wedge to the wedge retainer. For example, an enlarged portion of the wedge may be configured to fit within in a groove in the wedge retainer. Any suitable means to detachably attach the wedge to the wedge portion may be employed.

As shown in FIG. 12, an exemplary split-end tool 10 has a grouping of hair 92 captured over the wedge 14 and within the slot 64 between the first 60 and second slot sides 62. In this embodiment, the first and second slot sides of the slot portion do not contact the wedge or a wedge retainer. The captured hair 92 is bent over the wedge and is forced down over either side of the wedge by the first slot side 60 and the second slot side 62. The wedge expands in width from the extended wedge end 40 to the wedge base 41, and therefore the captured hair is pinched with more force as the slotted arm is pressed down. The wedge portion 38 as shown in FIG. 12 is a single piece and is not attached to a wedge retainer.

As shown in FIG. 13, an exemplary wedge 14 is more narrow at the top, or the extended wedge end 40, than at the wedge base 41. The wedge base 41 comprises an extended or protruding portion that may interfere with the slot slides as the slotted arm is pressed down.

As shown in FIG. 14, an exemplary wedge 14 is wider at the top, or the extended wedge end 40, than at the wedge base 41. There is an extension or protrusion at the wedge base and this may be a wedge retainer feature 48 that fits within a slot of a wedge retainer (not shown).

As shown in FIG. 15, an exemplary wedge 14 has an enlarged rounded portion at the extended wedge end 40. This type of extended wedge end may promote hair sliding through the tool to expose new sections of hair having split-ends.

As shown in FIG. 16, an exemplary wedge portion 14 has an extended wedge end 40 that is configured with a plurality of teeth 49. This particular wedge extended end geometry may be well suited for medium to coarse hair. The teeth have a width Wt and height Ht, as shown. In addition, there is a gap between the teeth having a width of Wtg, as shown. The width of the teeth, and/or the width of the gap between the teeth may be any suitable dimension including, but not limited to, about 1 mm or more, about 2 mm or more, about 4 mm or more, about 8 mm or more, about 12 mm or more, and any range between and including the dimensions provided. The teeth may have a height of about 1 mm or more, about 2 mm or more about 4 mm or more, about 8 mm or more, about 12 mm or more, and any range between and including the dimensions provided.

As shown in FIG. 17, an exemplary wedge portion 14 has an extended wedge end 40 that is recessed along the length between the two protruding wedge ends 47 and 47' having a height Hr. This particular wedge geometry may be well suited for wavy to curly hair.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A split-end tool comprising:

a. a wedge arm comprising:
  i. a pivot end and an extended end;
  ii. a handle;
  iii. a wedge portion comprising a wedge having an extended wedge end;
  wherein the wedge has a wedge length that extends along a length of the wedge arm, wherein the length of the wedge arm is measured from said pivot end to said extended end of the wedge arm;

b. a slotted arm comprising:
  i. a pivot end and an extended end;
  ii. a handle;
  iii. a slotted portion comprising:
    a first slot side;
    a second slot side; and
    a slot configured between the first and second slot sides;
  wherein a protruding wedge portion of the wedge is configured to extend through the slot;
  wherein the slot has a slot width that is at least 1 mm greater than a maximum wedge thickness of the protruding wedge portion;
  whereby the wedge does not contact the first or second slot sides when moving from an open to a fully closed configuration; and c. a pivot configured proximal to said pivot ends that attaches the wedge arm to the slotted arm;

wherein the extended end of the wedge arm is configured to pivot toward and away from the extended end of the slotted arm; wherein the extended wedge end of the wedge arm extends through the slot when the split-end tool is in the fully closed configuration with the wedge arm pivoted towards the slotted arm to expose split-ends of hair and allow trimming of said split-ends of hair that is folded around the extended wedge end and extends back over the protruding wedge portion, through the slot between the wedge and both the first and second slot sides; and wherein the extended wedge end of the wedge arm pivots completely out of the slow when in the open configuration; and d. an opening feature configured to force the extended ends of the wedge arm and the slotted arm open when the split-end tool is in the fully closed configuration.

2. The split-end tool of claim 1, wherein the wedge is detachably attachable to a wedge retainer.

3. The split-end tool of claim 1, wherein the wedge arm handle is configured between the wedge arm pivot end and the wedge portion, and wherein the slotted arm handle is configured between the slotted arm pivot end and the slotted portion.

4. The split-end tool of claim 1, wherein the extended wedge end is a straight extended wedge end.

5. The split-end tool of claim 1, wherein the extended wedge end has a thickness of 2 mm or more and does not cut hair when the wedge end extends through the slotted portion.

6. The split-end tool of claim 1, wherein the extended wedge end comprises a plurality of teeth having a tooth height to a tooth width ratio of no more than 2.0.

7. The split-end tool of claim 6, wherein the extended wedge end is a scalloped extended wedge end having a ratio of a scallop height to a scallop center-to-center of no more than 3.

8. The split-end tool of claim 7, wherein the scalloped extended wedge end has a center-to-center distance of 5 mm or less.

9. The split-end tool of claim 1, wherein the wedge length is 5 cm or more.

10. The split-end tool of claim 1, wherein the protruding wedge portion has a protruding height of 2 mm or more.

11. The split-end tool of claim 1, wherein the wedge has an irregular cross-sectional shape across the length.

12. The split-end tool of claim 1, wherein the wedge expands in width from the extended wedge end to a wedge base.

13. The split-end tool of claim 1, wherein the extended wedge end comprises an enlarged and rounded extended wedge end.

14. The split-end tool of claim 1, wherein the slot has a slot width of 5 mm or more.

15. The split-end tool of claim 1, comprising an interference location between the wedge arm and the slotted arm that produces a gap between the wedge and the first slot side and the second slot side when in said fully closed configuration.

16. The split-end tool of claim 1, wherein the slotted portion has an open extended end.

17. The split-end tool of claim 1, wherein the opening feature comprises a spring.

18. A method of cutting split-ends comprising the step of:

a. providing a split-end tool as described in claim 1;

b. placing a person's hair over the extended wedge end and closing the split-end tool to capture said person's hair within the slot and over the extended wedge end; wherein the person's hair folds over the extended wedge end to expose split-ends; and c. manually cutting off said split-ends with a separate cutting device.

19. The method of cutting split-ends of claim 18 further comprising the steps of sliding the split-end tool along said person's hair to expose additional split-ends and cutting off said additional split-ends.

* * * * *